United States Patent [19]

Duenser

[11] 4,226,007

[45] Oct. 7, 1980

[54] SEALLESS STRAP CONNECTION

[75] Inventor: William F. Duenser, Mt. Prospect, Ill.

[73] Assignee: Signode Corporation, Glenview, Ill.

[21] Appl. No.: 21,264

[22] Filed: Mar. 16, 1979

[51] Int. Cl.[3] ..... B65D 63/02

[52] U.S. Cl. ..... 24/20 EE; 24/23 EE; 403/393

[58] Field of Search ..... 24/20 EE, 20 R, 20 CW, 24/23 EE; 403/375, 393

[56] References Cited

U.S. PATENT DOCUMENTS

| | | | |
|---|---|---|---|
| 2,268,339 | 12/1941 | Leslie | 24/20 EE |
| 2,276,988 | 3/1942 | Leslie | 24/20 EE |
| 2,626,456 | 1/1953 | Harrison | 24/20 R |
| 3,303,541 | 2/1967 | Beach | 24/20 EE |
| 3,426,392 | 2/1969 | Timmerbeil | 24/20 EE |
| 3,935,616 | 2/1976 | Simmons | 24/20 EE |
| 4,031,594 | 6/1977 | Cepuritis | 24/23 EE |
| 4,048,697 | 9/1977 | Duenser | 24/20 EE |
| 4,062,086 | 12/1977 | Wojcik | 24/20 EE |

*Primary Examiner*—Victor N. Sakran

*Attorney, Agent, or Firm*—Dressler, Goldsmith, Shore, Sutker & Milnamow, Ltd.

[57] ABSTRACT

A sealless strap connection is provided between a first and second overlapped length of strap and comprises an array of longitudinally spaced joints with each joint comprising lengthwise opposed protuberances displaced from their respective planes of the overlapped lengths of strap and interlocked with each other. The protuberances on the first length of strap are longitudinally spaced in a first and second group with the protuberances of the first group equally spaced from each other and with the spacing of the adjacent protuberances of the second group progressively increased in the direction away from the first group. The protuberances on the second length of strap are longitudinally spaced in first and second groups with the protuberances of the first group equally spaced from each other and with the spacing of the adjacent protuberances of the second group progressively increasing in the direction away from the first group. The first and second group of protuberances on the first length of strap are interlocked with the second and first groups of protuberances, respectively, on the second length of strap whereby, when the connection is initially formed, the protuberances intermediate the ends of the connection interlock before the protuberances at the ends of the connection.

6 Claims, 8 Drawing Figures

SEALLESS STRAP CONNECTION

DESCRIPTION

1. Technical Field

This invention relates to sealless connections in strap made of relatively stiff sheet material, i.e., metal strap and the like.

2. Background of the Invention

It is known to provide sealless connections between overlapping ends of a tensioned strap loop wherein the connection is in the form of an array of longitudinally spaced joints. A widely used connection of this type is that disclosed in the U.S. Pat. No. 3,303,541 to Beach and in the U.S. Pat. No. 3,935,616 to Simmons. The Simmons patent discloses an additional feature, a pair of anti-reverse abutment protuberances, that prevents accidental release of the connection when the tension on the strap is released.

The connection disclosed in the Beach and Simmons patents basically requires that a plurality of Z-shaped slits be formed in each end of the strap at a uniform spacing with each Z-shaped slit defining a pair of protuberances presenting opposed shoulders, one displaced upwardly from the strap and one displaced downwardly from the strap. The strap ends are overlapped and aligned so that the protuberances on one strap end interfit and interlock with and between the protuberances on the other strap end.

When placing the strap ends together to form a connection of the type disclosed in the Beach and Simmons patents, it has been found desirable to cause the interlocking protuberances in the middle of the array to interlock first, before the protuberances at either end of the array interlock. If the protuberances at the ends of the array interlock first, there is a higher probability that the joint will fail with a tear or rupture of the strap at a slit at one of the two ends of the array.

To overcome this problem, connections of the type disclosed in the Beach and Simmons patents have been made with strap in which the protuberances in the middle of the array project outwardly less than the shoulders at the ends of the array. Thus, when the strap ends are overlapped and interlock, protuberances in the middle of the array come into contact first. As the overlapping strap ends are pulled in a loop tensioning direction, the interlocking protuberances in the middle of the array deform somewhat and the protuberances at the ends of the array, which project outwardly from the strap more than the protuberances at the middle of the array, finally begin to engage and interlock. A connection thus formed has less tendency to tear at the slits.

Typically, when a bale of compressible material, such as cotton, is initially bound with a strap loop, the tension in the strap loop is about 1200 pounds. With such a tension, the interlocking protuberances near the middle of the connection do not get distorted very much. Thus, when the bale of cotton is subsequently compressed to a greater density and smaller size, the strap loop can be relatively easily removed, since there is no significant distortion in the protuberances which prevent disengagement. Next, a smaller strap, but with the same end connection configuration, is placed around the smaller bale, which is still under compression, and the strap ends are connected. Subsequently, the compression on the smaller bale is released so that the bale expands into engagement with the smaller strap loop. This places the strap loop under tension, thus ensuring a tight connection between the overlapped strap ends.

Though the above-described connection (wherein the protuberances at the ends of the array project outwardly more than the protuberances at the middle of the array) works satisfactorily in most circumstances, it has been found that a problem arises when the connection is formed but when the loop is not under tension. In this situation, the overlapping strap ends tend to lie loosely in a face-to-face relationship and spaced away from each other by a small gap owing to the contact between the outwardly projecting shoulders. With anti-reverse abutment protuberances provided as disclosed in the Simmons patent, the gap between the two overlapping strap ends may be great enough to prevent accurate alignment of such abutment protuberances and this can permit accidental disengagement of the connection.

To overcome this problem, it would be desirable to provide a sealless connection wherein the overlapping protuberances at the middle of the array would interlock before the overlapping protuberances at the ends of the array and also wherein the overlapping strap ends, when the connection is untensioned, would remain relatively close together in face-to-face relationship. This would ensure the proper operation of anti-reverse abutment protuberances.

SUMMARY OF THE INVENTION

The present invention contemplates a sealless strap connection between first and second overlapped lengths of strap which comprises an array of longitudinally spaced joints. Each strap has a plurality of Z-shaped slits. Each slit defines a pair of opposed protuberances which project from opposite sides of the strap as disclosed in the above-discussed Beach and Simmons patents. However, the Z-shaped slits are not all equally spaced along the strap.

Specifically, the protuberances on each of the first and second overlapping strap end portions are arranged in two groups. In the first group, the protuberances are equidistantly spaced and at least one of the protuberances is adapted to function as an initial engagement protuberance. In the second group of protuberances, the protuberances are increasingly spaced apart in a direction away from the first group of protuberances. To form the connection, the strap end portions are overlapped with the initial engagement protuberances on each end portion aligned to interlock and the strap ends are tensioned to cause deformation of the interlocking initial engagement protuberances. As tension is applied, the first protuberance group on the first strap end portion begins to interlock with the second protuberance group on the second strap end portion while the second protuberance group on the first strap end portion begins to interlock with the first protuberance group on the second strap end portion in such a way that the initial engagement protuberances fully interlock and deform before the other protuberances fully interlock. The last protuberances to interlock and deform are those at opposite ends of the arrays of protuberances.

The sealless strap connection in accordance with the present invention does not require the protuberances at the opposite ends of the array of joints to project outwardly from the strap more than the protuberances at the middle of the connection. Consequently, all of the protuberances can be formed to project outwardly from the strap by the same amount and, by only the minimum amount necessary to permit the protuberances to interlock. This connection structure reduces the gap between the surfaces of the overlapping strap ends when the tension on the strap loop has been released. The reduction in the gap ensures proper operation of the anti-reverse abutment protuberances, if used.

It is seen that the combined effect of the various elements associated in accordance with the present invention is greater than the sum of the several effects of those elements taken separately. The novel combination of elements in accordance with the present invention yields desirable, beneficial and synergistic results—results which are also a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figures 1, 2, 3, 4:
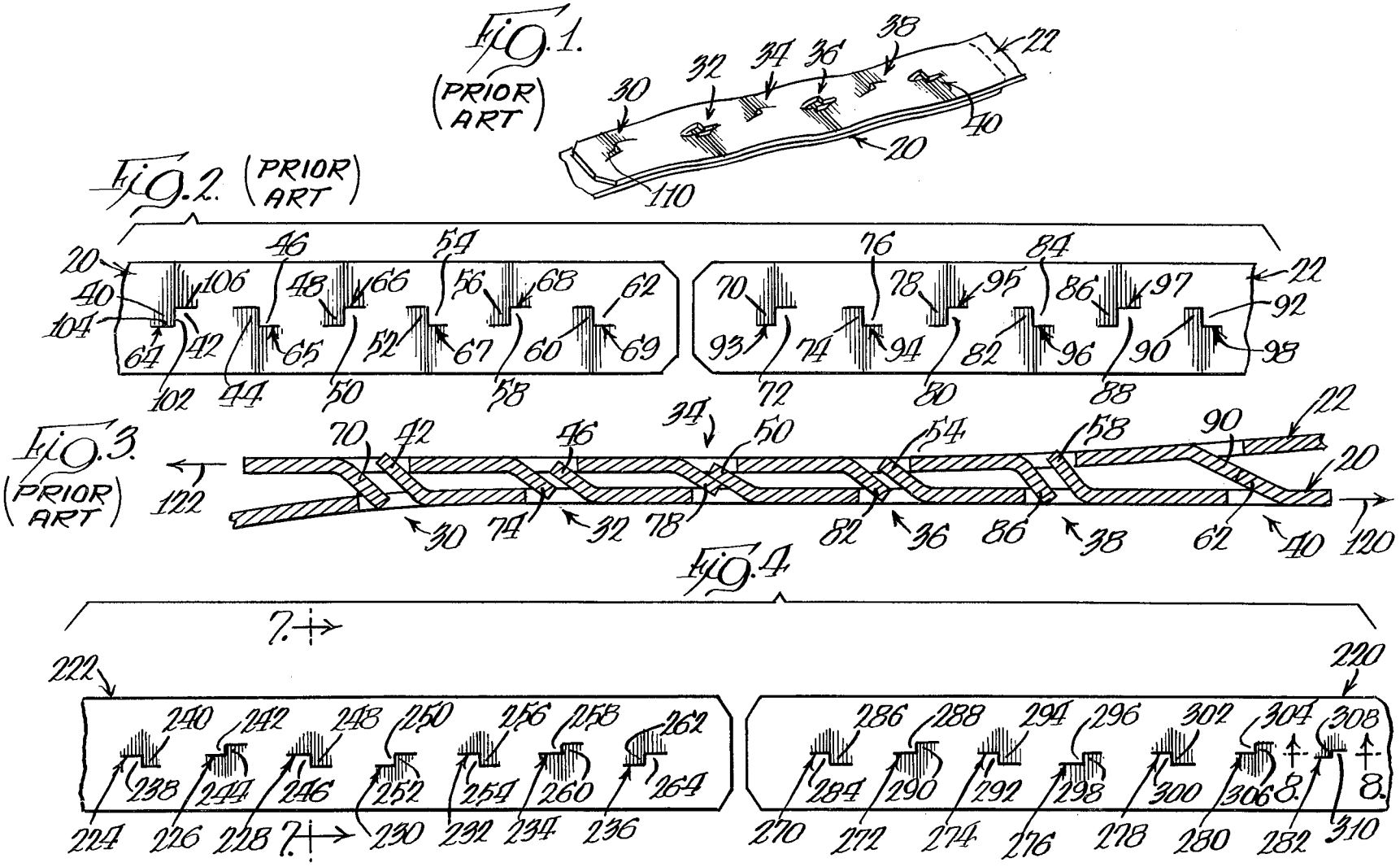
FIG. 1. (PRIOR ART)
FIG. 2. (PRIOR ART)
FIG. 3. (PRIOR ART)
FIG. 1 is a fragmentary perspective view of overlapping end portions of a strap loop forming a sealless strap connection in accordance with the teachings of the prior art.
FIG. 2 is an enlarged, fragmentary plan view of the strap ends of FIG. 1 before they are overlapped to form the interlocking connection.
FIG. 3 is a sectional elevation on an enlarged scale and illustrating the action of the interlocking protuberances of the prior art strap connection illustrated in FIG. 1 when the tension on the strap loop is released.
FIG. 4 is an enlarged fragmentary plan view of the strap ends with protuberances formed in accordance with the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes of the strap connection elements herein described are not essential to the invention unless otherwise indicated, since the invention is described with reference to an embodiment which is simple and straightforward.

For ease of description, the strap connection of this invention and the strap structure of this invention will be described in a particular orientation, and terms such as upper, lower, horizontal, etc., will be used with reference to this particular orientation. It will be understood, however, that the strap and strap connection of this invention may be manufactured, stored, transported and sold in an orientation other than the particular position described.

FIGS. 1 through 3 illustrate the sealless strap connection of the prior art and upon which the present invention is an improvement. The prior art strap connection is fully described in the U.S. Pat. No. 3,935,616 to Simmons and reference is directed thereto. A brief discussion of this prior art connection is presented here so as to provide a basis for understanding the novel changes to this connection in accordance with the present invention.

Specifically, the prior art strap connection is formed between two overlapping ends of a strap, strap end 20 and strap end 22. Typically, the strap is looped around a compressed material and the strap ends are connected, in a manner to be described in detail below, and the compression of the material within the strap loop is relieved so that the material expands against the loop and places the strap loop under tension, thereby securing the connection against disengagement.

As illustrated in FIG. 1, the prior art connection between the first and second overlapped lengths of strap, 20 and 22, comprises an array of longitudinally spaced joints, 30, 32, 34, 36, and 38. The connection has an additional feature, an anti-reverse engagement structure 40, which will be explained in more detail hereinafter.

With reference to FIG. 2, the first strap length or end 20 is seen to have a group of pairs of opposed protuberances, to wit: pair 40 and 42, pair 44 and 46, pair 48 and 50, pair 52 and 54, pair 56 and 58, and pair 60 and 62 defined by generally Z-shaped slits 64, 65, 66, 67, 68, and 69, respectively. Similarly, the second strap length or end 22 has a plurality of pairs of opposed protuberances, to wit: pair 70 and 72, pair 74 and 76, pair 78 and 80, pair 82 and 84, pair 86 and 88, and pair 90 and 92 defined by generally Z-shaped slits 93, 94, 95, 96, 97, and 98, respectively.

By way of example with reference to slit 64 in FIG. 2, each slit can be seen to comprise a lateral jog region 102 generally perpendicular to the length of the strap and two slit end regions 104 and 106 generally parallel to the length of the strap. In the region of each slit, the strap is deformed to provide nestable strap sections comprising matched integral portions of the metal strap length which are partly offset, above or below the plane of the strap. The lateral jog region of the slit, for example, jog region 102 for slit 64 in FIG. 2, can be said to define opposed shoulders on each protuberance, one such shoulder 110 being visible in FIG. 1 for joint 30 and lying parallel to lateral jog region 102 of the slit 64.

FIG. 3 illustrates a simplified cross-sectional view of the strap connection of FIG. 1 in which, at each joint a protuberance on one strap end interlocks with an opposed protuberance on the other strap end. For simplicity, the outer protuberances on each strap are not shown. That is, for example, with reference to FIG. 2 and with respect to joint 30 in FIG. 3, outer protuberance 72 on upper strap end 22 and outer protuberance 40 on lower strap end 20 are not shown. Only the interlocking protuberances, protuberance 70 of the upper strap end 22 and protuberance 42 of the lower strap end 20 are illustrated as being aligned for interlocking engagement. It can be seen that each interlocking protuberance is nestable within the jog region (e.g., jog region 102 of slit 64 in FIG. 2) and is enterable endwise into the opposing slit end region of the overlying strap section to establish a one-way interlocking engagement.

FIG. 3 shows the connection formed between the overlapping strap ends 20 and 22 either before tension has been applied to the loop or after tension has been released. As can be seen, the interlocking protuberances 78 and 50 in the middle of the connection have made contact as they begin to interlock. In contrast, the protuberances in the other joints of the connection have not contacted and fully interlocked. This is because the protuberances in the middle of the connection, that is, the protuberances 78 and 50, do not project outwardly very much from the plane of their respective strap ends. In contrast, the interlocking protuberances on either side of the middle protuberances (e. g., interlocking protuberances 46 and 74 and interlocking protuberances 54 and 82) are formed to project outwardly by a greater amount. The interlocking protuberances at the ends of the connection (e.g., pair 42 and 70 and pair 58 and 86) are formed to project outwardly even more.

Consequently, when the overlapping strap ends 20 and 22 are aligned for forming the strap connection, the first protuberances to engage are the ones at the middle of the connection, i.e., protuberances 78 and 50, as illustrated in FIG. 3. If little or no tension were applied to the overlapping strap ends, only the middle two protuberances, 50 and 78, would be in contact. The remaining protuberances would be spaced apart as illustrated in FIG. 3.

However, when material around which the strap loop has been placed is allowed to expand into contact with the loop and place the strap loop under tension, the initially engaged protuberances 50 and 78 begin to deform as the strap ends move in opposite directions as indicated in FIG. 3 by arrows 120 and 122. After the protuberances 50 and 78 have deformed a slight amount, the next interlocking protuberances on either side, interlocking pair 74 and 46 and interlocking pair 82 and 54, come into contact with each other and also begin to deform. Ultimately, the interlocking protuberances at either end of the connection, interlocking pairs 70 and 42 and interlocking pair 86 and 58, come into contact and fully engage.

It has been found that when the connection is formed in accordance with FIG. 3, wherein the interlocking protuberances in the middle of the connection are initially loaded and wherein the interlocking protuberances on either end of the connection are loaded last, the tendency for the strap to tear or rupture is considerably reduced. In fact, it has been found that if the protuberance at the ends of the connection are initially loaded instead, the tendency for the strap to tear or rupture at those protuberances is much more pronounced. Although this problem could be overcome by providing a thicker strap, it is economically desirable to use the thinnest strap possible for a given design loading. Hence, thinner strap can be used if the interlocking protuberances at the middle of the connection are loaded first.

When the strap protuberances are formed as illustrated in FIG. 3, it is seen that this prior art connection, when not under tension, has a considerable gap between the surfaces of the two strap ends. This is because the increased projection of the protuberances on the ends of the connection cause the overlapping strap ends to rest on the projecting surfaces of the protuberances at the connection ends. This situation does present a problem if an anti-reverse structure is provided in the connection as set forth in the aforementioned U.S. Pat. No. 3,935,616 to Simmons.

Specifically, an anti-reverse structure of the type set forth in the Simmons patent is illustrated in FIG. 3 as being formed by protuberances 90 and 62 on the right-hand end of the connection. The protuberances 90 and 62 are formed differently than the interlocking protuberances. Specifically, they are formed so that instead of overlapping and interlocking, they abut in an end-to-end alignment. Then, when the joint is in the untensioned condition, as illustrated in FIG. 3, movement of the straps in the connection disengaging direction (in the direction opposite to the arrows 120 and 122) will cause the protuberances 90 and 62 to abut and prevent further movement of the strap ends in the disengaging direction. This will prevent complete disengagement of the connection.

Such a feature is very useful when the strap is intially placed about a compressed material and the connection initially formed. Until the compression on the material is released, the strap loop is not under tension and the connection may become disengaged if it is accidentally bumped. The anti-reverse protuberances 90 and 62 are thus intended to solve this problem. However, when the overlapping strap ends 20 and 22 are spaced apart by the increasing projection of the interlocking protuberances found in the prior art structures, it is possible that the anti-disengagement protuberances 90 and 62 may become misaligned and may slide past each other with the undesirable consequence of permitting the connection to become entirely disengaged.

The novel connection of the present invention overcomes the above-described problem wherein the anti-reverse protuberances accidentally slide past each other without abutting. Further, the present invention solves this problem by providing a connection in which the interlocking protuberances in the middle of the connection are still engaged before the protuberances on the ends of the connection.

According to the present invention, and with reference to FIG. 4, a strap is provided with two strap ends, end 220 and end 222, which are adapted to be overlapped and connected together when the strap is looped about material to be bound. End 222 has a plurality of generally Z-shaped slits 224, 226, 228, 230, 232, 234, and 236 which define pairs of protuberances, to wit: pair 238 and 240, pair 242 and 244, pair 246 and 248, pair 250 and 252, pair 254 and 256, pair 258 and 260, and pair 262 and 264, respectively. As in the prior art structures discussed above, each pair of protuberances defined by a single Z-shaped slit is arranged with one of the protuberances projecting upwardly from the plane of the strap and with the other of the protuberances projecting downwardly below the plane of the strap. Similarly, strap end 220 has a plurality of generally Z-shaped slits 270, 272, 274, 276, 278, 280, and 282 which define pairs of protuberances, to wit: pair 284 and 286, pair 288 and 290, pair 292 and 294, pair 296 and 298, pair 300 and 302, pair 304 and 306, and pair 308 and 310, respectively.

Figure 7:
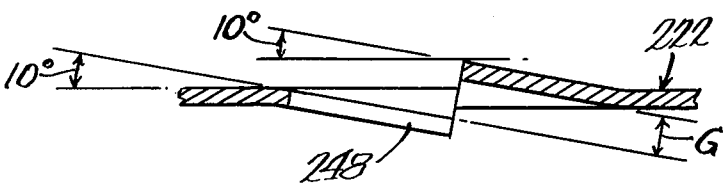
FIG. 7 is an enlarged, fragmentary, cross-sectional view taken along the plane 7—7 in FIG. 4.

Unlike the prior art structures discussed above, all of the protuberances, except for pair 262 and 264, and pair 308 and 310, which are part of the anti-reverse feature explained hereinafter, have the same shape and project outwardly above or below the plane of the strap by an equal amount. As illustrated in FIG. 7 for slit 228, which is typical of all of the slits except for the anti-reverse feature slits 236 and 282, the protuberances are formed at an angle, preferably 10 degrees, with respect to the plane of the strap and define a gap G at the middle or lateral jog region of the slit. The gap G, for a given strap thickness, is constant for all of the protuberances except the anti-disengagement protuberances defined by slits 236 and 282 which will be explained in more detail hereinafter.

Though all of the interlocking protuberances have the same projection from the plane of the strap according to the present invention, the spacing between adjacent slits in each strap length defining the protuberances is not uniform. This is clearly illustrated in FIGS. 5 and 6.

Figure 5:
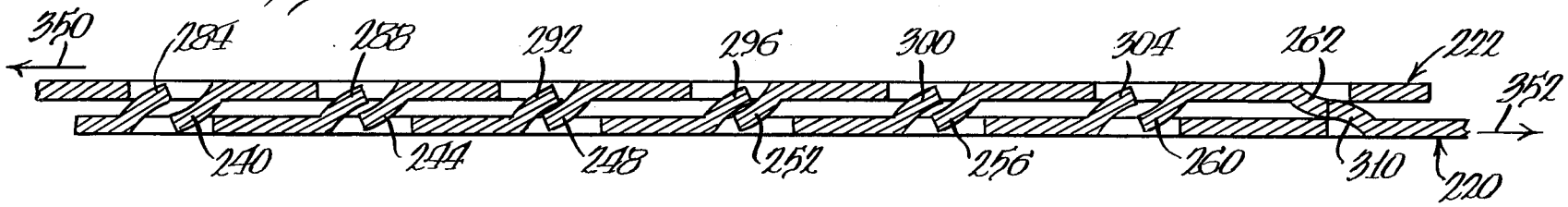
FIG. 5 is a sectional elevation on an enlarged scale of the strap ends of FIG. 4 in accordance with the present invention and illustrating a formed, but untensioned, connection.
Figure 6:
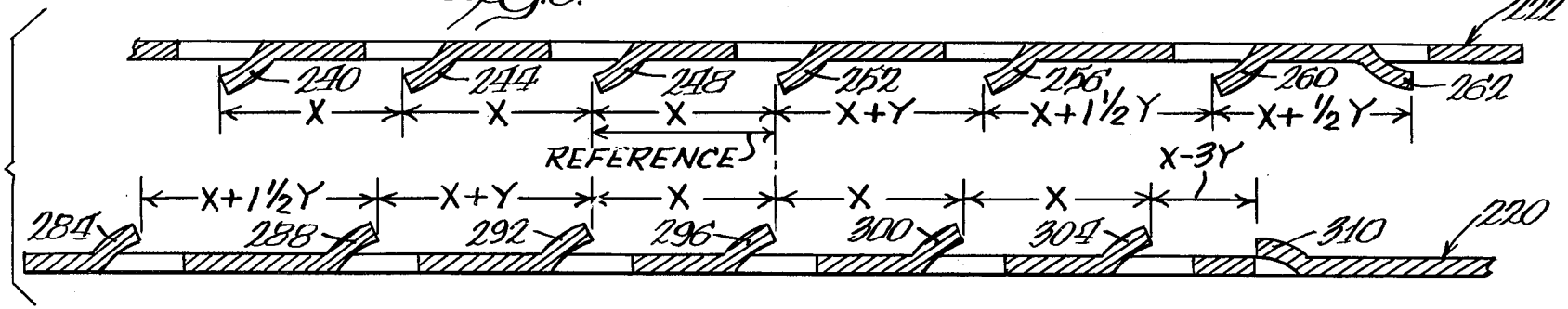
FIG. 6 is a sectional elevation on an enlarged scale of the strap ends illustrated in FIGS. 4 and 5 with the strap ends overlapping but spaced away from each other.

As discussed above for FIG. 3, the enlarged sectional elevational views of FIGS. 5 and 6 have been simplified by eliminating the non-interlocking protuberances at each slit region. For example, by comparison of FIG. 4 with FIGS. 5 and 6, it is seen that FIG. 5 shows interlocking protuberance 284 on strap end 220 but does not show the downwardly projecting non-interlocking protuberance 286. Similarly, on strap end 222, interlocking protuberance 240 is illustrated but the non-interlocking protuberance 238 that projects upwardly above the plane of the strap is not shown.

As best illustrated in FIGS. 5 and 6, strap length or end 222 has a first group of protuberances 240, 244, 248, and 252 which are equally spaced from each other and has a second group of protuberances, 256 and 260, wherein the spacing between the second group of protuberances progressively increases in the direction away from the first group of protuberances, i.e., toward the right in FIGS. 5 and 6. With reference to FIG. 6, the first group of protuberances 240, 244, 248, and 252 are shown equally spaced along the strap end 222 by a distance X. In contrast, the spacing between protuberances 252 and 256 is X plus an additional distance Y and the spacing between protuberances 256 and 260 is $X+1\frac{1}{2}$ Y. Similarly, the other strap length or end 220 has a first group of interlocking protuberances 292, 296, 300 and 304, which are equally spaced by the distance X. Also, strap end 220 has a second group of protuberances, 288 and 284, which are not equally spaced. Specifically, the spacing between protuberances 288 and 292 is X+Y and the spacing between protuberances 288 and 284 is $X+1\frac{1}{2}$ Y. Thus, the spacing of adjacent protuberances in the second group of protuberances on the strap end 220 is progressively increasing in the direction away from the first group of equally spaced protuberances on the same strap end.

The protuberances are located in the strap ends according to the present invention to enable the protuberances in the middle of the ultimately formed connection to engage first and to permit the protuberances at the extreme ends of the connection to engage last. To this end, the protuberances in the middle of the array of protuberances on each strap end can be regarded as "initial engagement" protuberances. In FIGS. 5 and 6, the initial engagement protuberances are shown as protuberances 248 and 252 on strap end 222 and protuberances 292 and 296 on strap end 220. It is seen that the initial engagement protuberances 248 and 252 on strap end 222 are spaced apart by the distance X and the protuberances 292 and 296 on strap end 220 are likewise spaced apart by the same distance X.

To form the connection according to the present invention, the strap ends 220 and 222 are overlapped and placed in face-to-face relationship as illustrated in FIG. 5. The initial engagement protuberances, interlocking pair 292 and 248, and interlocking pair 296 and 252, interfit and begin to interlock as the strap ends are pulled in opposite directions as indicated by arrows 350 and 352. The other pairs of interlocking protuberances on either side of the initial engagement protuberances do not come into contact and begin to interlock until the initial engagement protuberances have interlocked and deformed somewhat. For example, protuberance 300 on strap end 220, spaced a distance X from initial engagement protuberance 296, does not initially come into contact with the interlocking protuberance 256 on the superposed strap end 222 because the protuberance 256 is spaced a distance X+Y away from the initial engagement protuberances 252 and hence, is spaced a distance Y from protuberance 300. Consequently, the interlocking initial engagement protuberances, such as protuberances 296 and 252, must be deformed by some amount in order for the protuberances 300 and 256 to contact and interlock. Similarly, since the outermost interlocking protuberance 260 on strap end 222 is a distance $X+1\frac{1}{2}$ Y from the protuberance 256, the protuberance 260 will not contact and interlock with the protuberance 304 on the superposed strap end 220 until the inner protuberances have interlocked and deformed by some amount.

On the other end of the connection, a similar condition obtains, except of course, the progressively increasing spacing between protuberances on the other end of the connection is on the strap end 220 and the uniform spacing is on strap 222. Specifically, protuberance 244 on strap end 222 does not interlock with protuberance 288 on strap end 220 until the initial engagement protuberances, such as 292 on strap end 220 and 248 on strap end 222 have deformed by some amount. By the same token, protuberances 240 on strap end 222 and 284 on strap end 220 do not contact and interlock until the inner protuberances have deformed.

Thus, it is seen that the novel joint configuration of the strap ends in accordance with the present invention permits the loading of protuberances in the middle of the array before the loading of the outermost protuberances at each end of the connection. This provides a joint that is less susceptible to tearing or rupture than one wherein the outermost protuberances of the connection are loaded first.

Although the embodiment illustrated in FIGS. 5 and 6 has two pairs of initial engagement protuberances, initial engagement protuberance pair 292 and 248 and initial engagement protuberance pair 296 and 252, it is to be understood that a satisfactory connection in accordance with the present invention can be achieved by providing only one pair of initial engagement protuberances or by providing more than two pairs of initial engagement protuberances.

With the novel connection of the present invention, it has been found that the overlapping strap ends 220 and 222 lie relatively close together in face-to-face relationship, even when no tension is applied to the strap ends. This is of great advantage in accommodating the additional anti-reverse engagement feature which is intended to prevent the strap ends from becoming completely disengaged in the untensioned condition.

Specifically, as illustrated in FIG. 5, anti-reverse protuberances 262 and 310 are provided on strap ends 222 and 220, respectively. These protuberances function as set forth in detail in the U.S. Pat. No. 3,935,616 to Simmons as discussed above. Specifically, the anti-reverse protuberances 262 and 310 are aligned to abut and prevent movement of the strap ends in connection-disengaging directions (opposite the arrows 350 and 352 in FIG. 5).

In contrast to the prior art, the protuberances at the connection ends in the present invention need not project outwardly from the plane of the strap more than the protuberances at the middle of the connection. Consequently, the interlocking protuberances can be formed with a relatively small amount of projection beyond the plane of the strap. The relatively small projection allows the strap ends to lie in a relatively close face-to-face configuration when the connection is in the untensioned condition. Consequently, the anti-reverse protuberances 262 and 310 cannot fail to abut by accidentally sliding past each other and, thus, cannot fail to prevent complete disengagement of the connection. This is made clear by comparing the anti-reverse protuberances 90 and 62 in FIG. 3 (prior art) with the anti-reverse protuberances 262 and 310 in FIG. 5. It can be seen that the gap between the overlapping strap ends 222 and 220 in FIG. 5 is so small that the anti-reverse protuberances 262 and 310 cannot possibly slide past each other. In contrast, the prior art anti-reverse protuberances illustrated in FIG. 3 could slide past each other because the gap between the strap ends 22 and 20 is much greater when the strap loop is in the untensioned condition.

To ensure that the anti-reverse protuberances function properly to prevent disengagement, at least one of the anti-reverse protuberances, and preferably both, are outwardly displaced from the strap by a distance which is not greater than the strap thickness, which distance is measured normal to the plane of the strap length.

Figure 8:
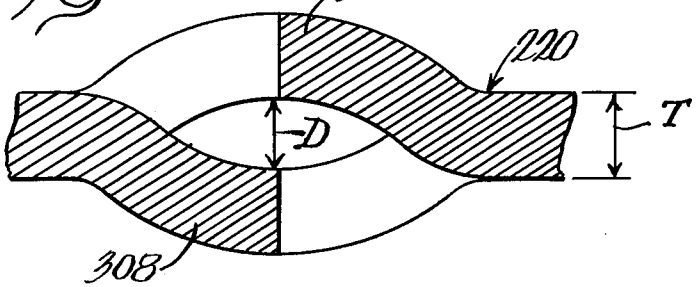
FIG. 8 is a greatly enlarged, fragmentary, cross-sectional view taken generally along the plane 8—8 in FIG. 4.

Specifically, with reference to the enlarged cross-sectional view of FIG. 8, the strap end 220 is shown as having a thickness T with the protuberances 308 and 310, formed from the strap end 220, necessarily also having a thickness T. Protuberance 310 is the anti-reverse protuberance which is adapted for abutting the anti-reverse protuberance 262 of the superposed strap end 222 as illustrated in FIG. 5. According to the present invention, it is desirable to form at least the protuberances 308 and 310 on strap end 220 as shown in FIG. 8 so that the gap or distance D between them is less than the thickness of the strap T. With this limitation, the abutting protuberance 262 of the superposed strap end 220 cannot slide underneath the anti-reverse protuberance 310 and between the protuberance 310 and the downwardly projecting protuberance 308.

It is necessary to limit the projection of only one of the anti-reverse protuberances above the surrounding strap. As illustrated in FIG. 5, the outward projection of anti-reverse protuberance 310 is so limited to define the gap D (FIG. 8) while the abutting anti-reverse protuberance 262 on strap 222 projects outwardly below the plane of the strap end 222 by a slightly greater amount. Regardless of how far outwardly anti-reverse protuberance 262 projects below the strap end 222, it can never pass below protuberance 310 in gap D since gap D is defined as being less than the thickness of the strap and hence less than the thickness of protuberance 262.

It is seen that the novel protuberance configuration for a strap connection in accordance with the present invention provides a connection in which the overlapping strap ends lie relatively close together in face-to-face relationship when the strap loop is in the untensioned condition so that the anti-reverse protuberances are unlikely to become misaligned and fail to properly abut. Further, the novel design of the present invention permits the designed projection of the anti-reverse protuberances outwardly of the strap to be reduced to a minimum so that the gap between each anti-reverse protuberance and the strap surface in the region below the protuberance is less than the strap thickness. This eliminates the possibility that the abutting anti-reverse protuberance could accidentally slip underneath.

As an example of the present invention, it has been found that steel strap having a thickness of about 0.025 inch and a width of about 0.75 inch functions well with the novel connection where the distance X is 0.562 inch, the distance Y is 0.010 inch, the gap G is 0.065 inch, and the gap D is 0.015 inch.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A sealless strap connection between first and second overlapped lengths of strap which comprises an array of longitudinally spaced joints;

each joint comprising lengthwise opposed protuberances displaced from the respective planes of said overlapped lengths of strap and interlocked with each other;

said protuberances on said first length longitudinally spaced in a first and second group with the protuberances of the first group equally spaced from each other and with the spacing of the adjacent protuberances of the second group progressively increasing in the direction away from said first group;

said protuberances on said second length longitudinally spaced in a first and second group with the protuberances of the first group equally spaced from each other and with the spacing of the adjacent protuberances of the second group progressively increasing in the direction away from said first group; and said first and second group of protuberances on said first length interlocked with said second and first group of protuberances, respectively, on said second length whereby when the connection is initially formed, protuberances intermediate the ends of the connection interlock before protuberances at the ends of the connection.

2. The sealless strap connection in accordance with claim 1 wherein said lengthwise opposed protuberances are defined by generally Z-shaped slits in said overlapping lengths of strap.

3. The sealless strap connection in accordance with claim 2 further including an integral abutment means located at one end of said array of joints and comprising an anti-reverse protuberance in each overlapping length of strap arranged so that upon shifting of the connected overlapping lengths of strap in a direction to disengage said interlocking engagement, said anti-reverse protuberances abut each other to inhibit separation of the connection, each said anti-reverse protuberance defined by a slit in the respective length of strap and outwardly displaced from the surface of the respective length of strap in the region of the slit, at least one of said two abutting anti-reverse protuberances outwardly displaced from the strap in the slit region by a distance which is not greater than the strap thickness, said distance being measured normal to the plane of the respective length of strap.

4. In a sealless strap connection between first and second overlapped lengths of metal strap, an array of longitudinally spaced shear lock joints, each joint being defined between nestable strap sections provided by matched integral portions of each length of metal strap, said nestable strap sections that define each joint being partly offset longitudinally to engage in a one way mutually interlocking relationship, each said nestable strap section having a single longitudinally oriented staggered slit comprised of lengthwise slit end regions and a lateral jog region joining the slit end regions, each staggered slit defining and being flanked by complementary integral strap web portions offset in opposite normal directions to present lengthwise opposed shoulders bordering the lateral jog region of the slit, each joint having each of its nestable strap sections presenting a locking protuberance nestable within the jog region of the other strap section and enterable endwise into the opposing slit end region of said other section to establish a one way interlocking engagement therebetween, a plurality of said protuberances on said first strap length being longitudinally spaced along the strap length at increasing distance increments with respect to a reference point on said connection, and a plurality of said protuberances on said second strap length being longitudinally spaced along the strap length at increasing distance increments with respect to said reference point on said connection in the direction opposite said increasing distance increments on said first strap length.

5. A strap segment having a first end portion and a second end portion adapted for forming a sealless strap connection when the portions are in an overlapped configuration, said first and second end portions each having longitudinally spaced joint elements;

each joint element comprising a lengthwise protuberance displaced from the plane of the strap segment and shaped to interlock with a superposed protuberance;

said protuberance on each of said first and second strap end portions arranged in a first group of equidistantly spaced protuberances, at least one of which protuberances is an initial engagement protuberance, and in a second group of protuberances which are increasingly spaced apart in the direction away from said first group of protuberances whereby, when the strap end portions are overlapped with (1) the initial engagement protuberances on each end portion aligned to interlock, (2) the first protuberance group on the first strap end portion superposed on the second protuberance group on the second strap end portion and, (3) the second protuberance group on the first strap end portion superposed on the protuberances group on the second strap end portion, the initial engagement protuberance fully interlock before other protuberances do when the strap end portions are each shifted in opposite longitudinal directions, the last formed protuberance interlocks occurring at opposite ends of said arrays of protuberances.

6. A sealless strap connection between first and second overlapped lengths of strap which comprises an array of longitudinally spaced joints;

each joint comprising lengthwise opposed protuberances displaced from the respective planes of said overlapped lengths of strap and shaped to interlock with each other;

a first group of said protuberances on said first strap length being spaced along said first strap length at equal distance increments;

a second group of said protuberances on said first strap length being spaced along said first strap length at increasing distance increments in the direction away from said first group of protuberances;

a first group of said protuberances on said second strap length being spaced along said second strap length at equal distance increments;

a second group of said protuberances on said second strap length being spaced along said second strap length at increasing distance increments in the direction away from said first group of said protuberances whereby, when said connection is initially formed, at least one of said protuberances of said first group on said first strap length intermediate the ends of the joint fully interlocks with one of said protuberances of said first group on said second strap length intermediate the ends of the connection before the protuberances on the ends of the connection fully interlock.

* * * * *